United States Patent [19]

Barton

[11] Patent Number: 4,747,025

[45] Date of Patent: May 24, 1988

[54] LOW VOLTAGE LIGHTING FIXTURE WITH TRACK ELECTRODES

[76] Inventor: Daniel W. Barton, 17170 Courtney La., Huntington Beach, Calif. 92649

[21] Appl. No.: 913,331

[22] Filed: Sep. 30, 1986

[51] Int. Cl.[4] ..... F21S 1/02

[52] U.S. Cl. ..... 362/147; 362/285; 362/370; 362/432; 211/94

[58] Field of Search ..... 362/125, 147, 270, 275, 362/285, 287, 351, 361, 370, 371, 419, 427, 430, 404, 432; 339/9 R, 20, 21 R, 21 S, 22 R, 22 B; 315/174, 172, 210, 312, 324; 211/94

[56] References Cited

U.S. PATENT DOCUMENTS

| | | | |
|---|---|---|---|
| 1,282,676 | 10/1918 | Carlin | 362/427 |
| 1,425,190 | 8/1922 | Gerald | 362/419 |
| 1,479,019 | 1/1924 | Wilson | 362/427 |
| 1,486,745 | 3/1924 | Haselton | 362/351 |
| 1,680,469 | 8/1928 | Morgan | 362/432 |
| 1,854,302 | 4/1932 | Hasen | 362/427 |
| 4,414,617 | 11/1983 | Galindo | 362/404 |
| 4,629,076 | 12/1986 | Amstutz et al. | 211/94 |

FOREIGN PATENT DOCUMENTS

| | | | |
|---|---|---|---|
| 916326 | 8/1954 | Fed. Rep. of Germany | 362/419 |

*Primary Examiner*—Larry Jones
*Assistant Examiner*—Noah Kamen
*Attorney, Agent, or Firm*—Kenneth W. Iles

[57] ABSTRACT

Track electrodes inserted into the slots of a slatwall display panel are connected to a reduction transformer output, conducting electricity to a two-contact lamp mounting bracket that supports an electric lamp. Position of the light is adjustable in three planes. Any desired number of lighting fixtures may be used with a slatwall.

4 Claims, 4 Drawing Sheets

Fig. 1.
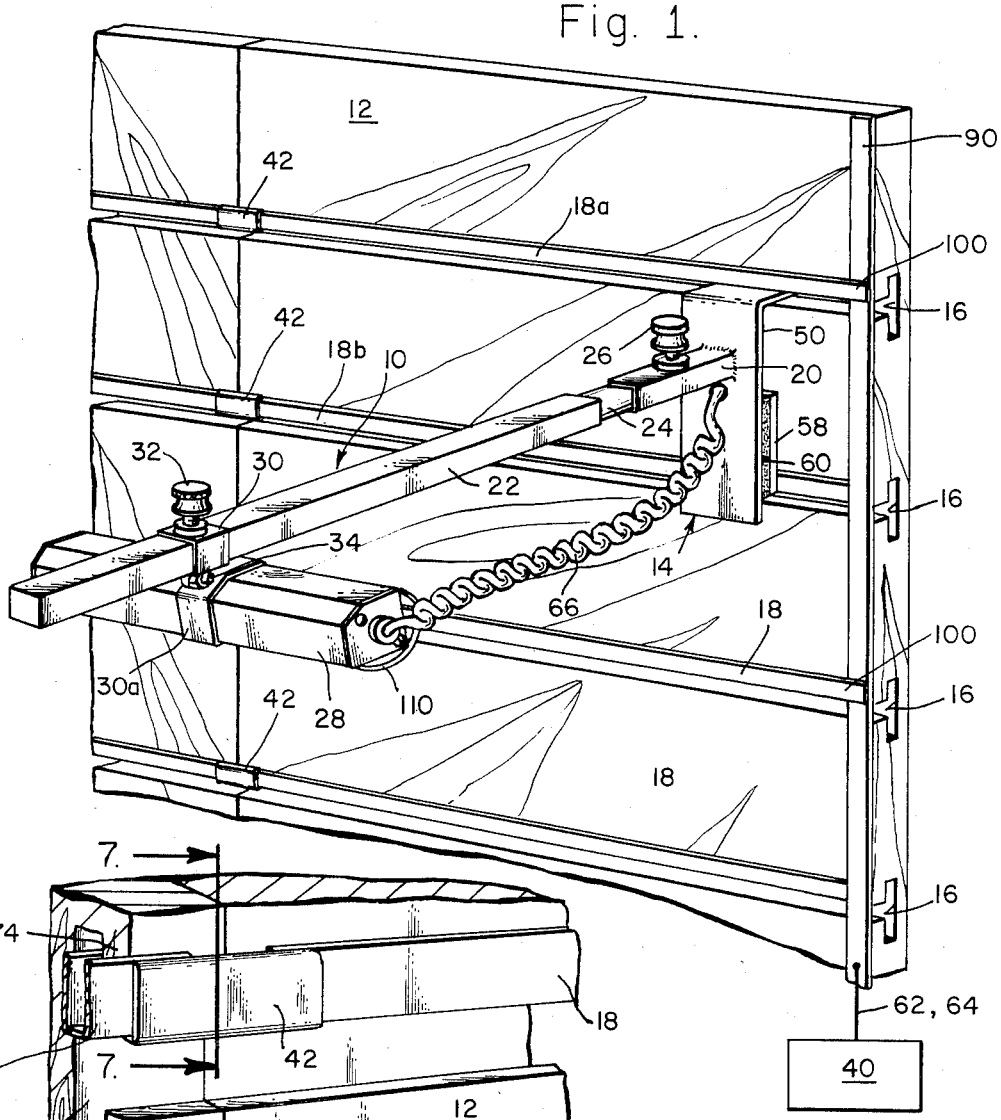
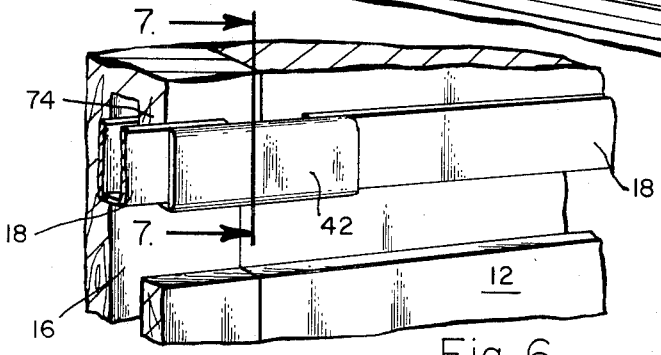
Fig. 6.
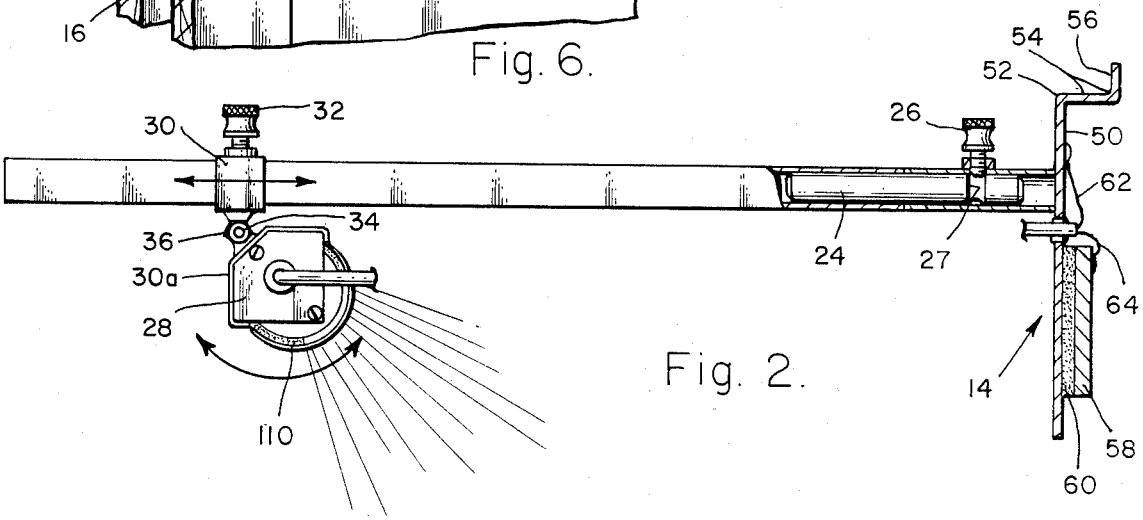
Fig. 2.

Fig. 5.
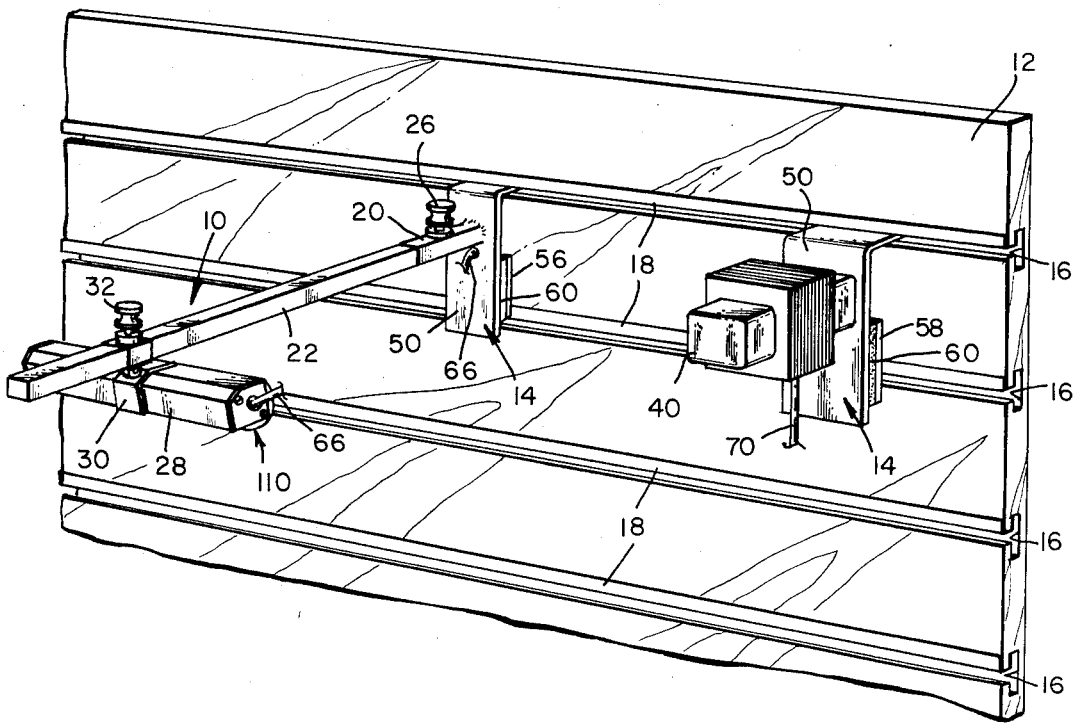
Fig. 4.
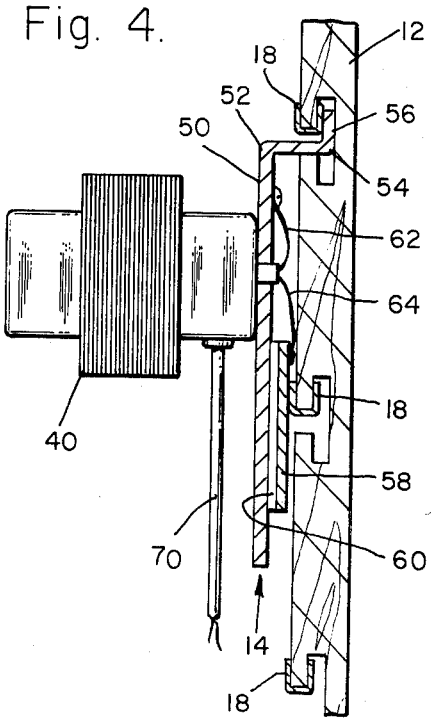
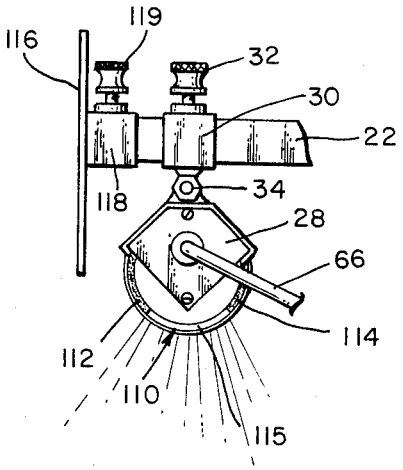
Fig. 8.

LOW VOLTAGE LIGHTING FIXTURE WITH TRACK ELECTRODES

BACKGROUND OF THE INVENTION

1. Field of the Invention

The present invention is directed to lighting fixtures. More particularly, the present invention is directed to a low voltage lighting fixture having track electrodes.

2. The Prior Art

Prior art lighting fixtures are typically of either standard incandescent lights or fluorescent lights. Ordinary incandescent lights, which use tungsten filaments, produce a great deal of heat relative to the amount of light they produce, which must be dissipated to prevent fire hazard. In many lighting applications, especially in retail display, incandescent lights would overheat if placed in the location that provides the best lighting, causing them to burn out prematurely or to create a fire hazard because the best location does not allow ready heat dissipation.

A common example of such a situation is the enclosed glass retail display case with lights along the inside of the top surface. The top of the display case naturally traps much of the heat generated by the lights. Ordinary incandescent lights cannot customarily be used in such display cases. Window displays are also often enclosed by partitions that create small enclosed spaces. These can often be lighted with ordinary incandescent lights only by using spotlights that are placed some distance away from the displayed goods themselves, in order to provide sufficient heat dissipation. When the light bulbs are placed some distance from the display, naturally the lighting tends to be flat and washed out and does not provide as much contrast and shadow, which add drama and appeal to a display, and, in the retail trade, increase sales.

In addition, the color temperature of ordinary incandescent lights is about 2,400 to 2,600 degrees Kelvin. Consequently, the colors of objects viewed under light from these bulbs are distorted, and are generally less attractive than they appear in sunlight.

Furthermore, incandescent lights produce light very inefficiently relative to other types of electric lamps, such as fluorescent lights, producing much waste heat from the wasted electricity. And the life expectancy of an ordinary incandescent light is very short, usually only about 750 hours to 1,000 hours. The only practical way to extend this life is to reduce the operating voltage of the light, which reduces both the light output and the color temperature of the light to a degree that most people will not accept.

Finally, when there are lighting applications suitable for ordinary incandescent lights, the heat dissipation requirements often also limit the selection of locations and positions that the lamps can be put in. This reduces the flexibility of the lighting system to be changed when the subject matter of the lighting is changed, as for example, window displays are frequently changed. The resulting lighting is substantially permanent, and difficult to change. It is certainly not portable. Aside from physical limitations naturally presented by the bulky physical apparatus, such lighting is nearly always operated by at least 120 volt alternating electric current, which Underwriters Laboratories classifies as permanent lighting installation. This classification leads to many electrical and heat dissipation requirements that greatly limit the arrangements that can be made with such lights.

To overcome these disadvantages of incandescent lights, fluorescent lights are often used in offices, retail displays, and so forth. Fluorescent lights, however, have several disadvantages that seriously limit their attractiveness. They produce a constant flicker that irritates many people and can cause headaches. They produce low intensity flat lighting, which does not make displays attractive. Moreover the spectrum of most fluorescent lights is heavily weighted in the yellow-green portion of the spectrum, producing an unpleasant distortion of all colors. In addition, fluorescent lights are bulky. Finally, they too are classified as permanent lighting installations by Underwriters Laboratories, triggering many restrictions on their connections and placements.

In many applications, especially displays of merchandise or art, the objects to be lighted are frequently changed or rearranged. When a display is changed, it is desirable to change the lighting of the display to enhance the attractiveness and clarity of the display. It is often difficult or impractical to change the lighting because the use of permanent lighting carries so many restrictions on placement and heat dissipation, and the fixtures and related equipment are essentially permanent by their nature and so are difficult to move. In the case of many incandescent lights and virtually all fluorescent lights, the light from the lamps cannot even be redirected.

In many display applications, merchandise or other items are displayed by hanging the items from slatwall, which is a generally wooden panel-like wall board having parallel longitudinal slots cut into it. Slatwall displays are customarily lighted in the manners described above. The difficulties associated with conventional display lighting, however, are exacerbated when the display is mounted on a slatwall. Items displayed on slatwalls are often in display windows, making the display items farther from ceiling lights or other permanent lights. In addition, items displayed on slatwalls are often relatively small items, such as shoes, handbags, stuffed animals, cameras, and so forth. Items like these are most effectively displayed when each item or group of items is individually lighted with a strong bright light. Finally, the displays on slatwalls are more likely to be changed frequently than are other types of displays because they are relatively easy to change and because they are often used for fashion merchandise.

Therefore a need exists for a lighting system that is portable under the definitions of the Underwriters Laboratory and many local building codes, that includes lights that can be readily repositioned and redirected to any desired direction at any time with a minimum of effort, that have a high color temperature to enhance the natural colors of objects, that can be placed near to the objects to be lighted, and that can be placed without regard for the need to dissipate heat and that is specifically adapted for use with existing slatwall display installations.

SUMMARY OF THE INVENTION

Accordingly, it is an object of the present invention to provide a lighting system that is portable under the Underwriters Laboratory definitions.

It is another object of the present invention to provide a lighting system that enables the user to change the number of lamps, the position of each lamp, and the direction of the light beam from each lamp easily.

It is another object of the present invention to provide a lighting system that consumes less energy for a given amount of light than conventional prior art lighting systems.

It is another object of the present invention to provide a lighting system that provides high contrast and deep shadows, if desired, to create drama and enhance the attractiveness of the display.

It is another object of the present invention to provide a lighting system that can be expanded easily to meet changing lighting needs.

It is another object of the present invention to provide a lighting system that is quick and easy to install and that can be installed by a non-electrician and that does not require building permits or building inspectors.

It is another object of the present invention to provide a lighting system that is particularly suitable for use with a slatwall retail product display.

These and other objects of the invention will become apparent upon consideration of the detailed description of a preferred embodiment of the invention, taken in conjunction with the drawings.

BRIEF DESCRIPTION OF THE DRAWINGS

Referring particularly to the drawings for the purpose of illustration only and not limitation, there is illustrated:

FIG. 1 is a perspective view of a lighting fixture according to the present invention installed on a section of slatwall.

FIG. 2 is a side elevation, partially in section, of the present invention as illustrated in FIG. 1.

FIG. 4 is side elevation, partially in section, of a transformer and mounting bracket according to the present invention.

FIG. 5 is a perspective view of the present invention illustrating the lighting fixture, transformer, and track electrical contacts installed on a section of slatwall having reenforcing members comprising aluminium extrusions, with the lamp facing downward.

FIG. 6 is a perspective view, partially in section, of a clip for electrically and mechanically joining contact tracks disposed in aligned slots of two adjacent pieces of slatwall.

FIG. 8 is an end elevation of the lamp housing illustrating the lamp lens.

DETAILED DESCRIPTION OF THE PREFERRED EMBODIMENTS

Figure 3:
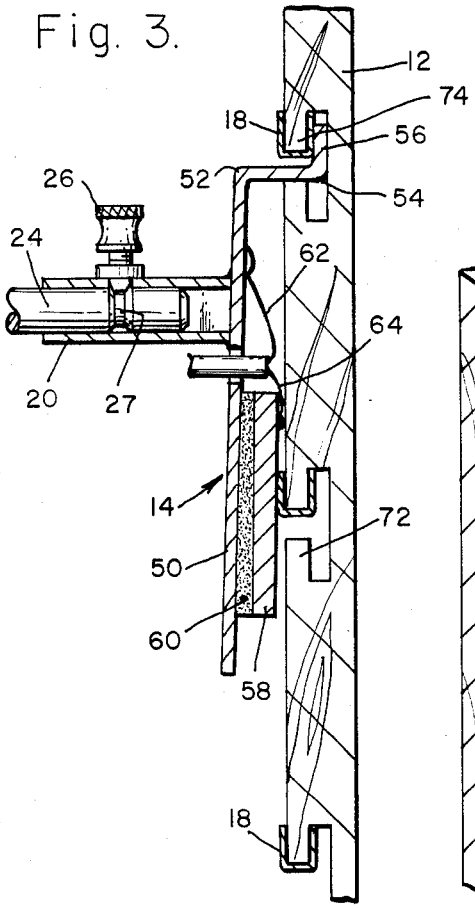
FIG. 3 is a side elevation of the present invention illustrating the electrical contact and support brackets.

Referring to FIG. 1, lighting fixture 10 is shown installed on slatwall 12. Lighting fixture 10 includes mounting bracket 14, which is retained in slat 16 of slatwall 12 and is held in contact with track electrodes 18 by gravity. Stub supporting arm 20, comprising a rectilinear metal tube, is welded to metallic mounting bracket 14, and secures supporting arm 22 of like material and construction, by means of rod 24 (FIG. 2) welded or otherwise fastened to the inside of supporting arm 22, which projects into stub arm 20, where it is held firmly by set screw 26, which seats in circumferential groove 27 of rod 24 (FIG. 2). Lamp housing 28 is fastened to support arm or supporting arm 22 by bracket 30, which is held in place along supporting arm 22 by set screw 32 and which includes resilient band **30*a* partially encircling and holding lamp housing 28** in position.

Figure 10:
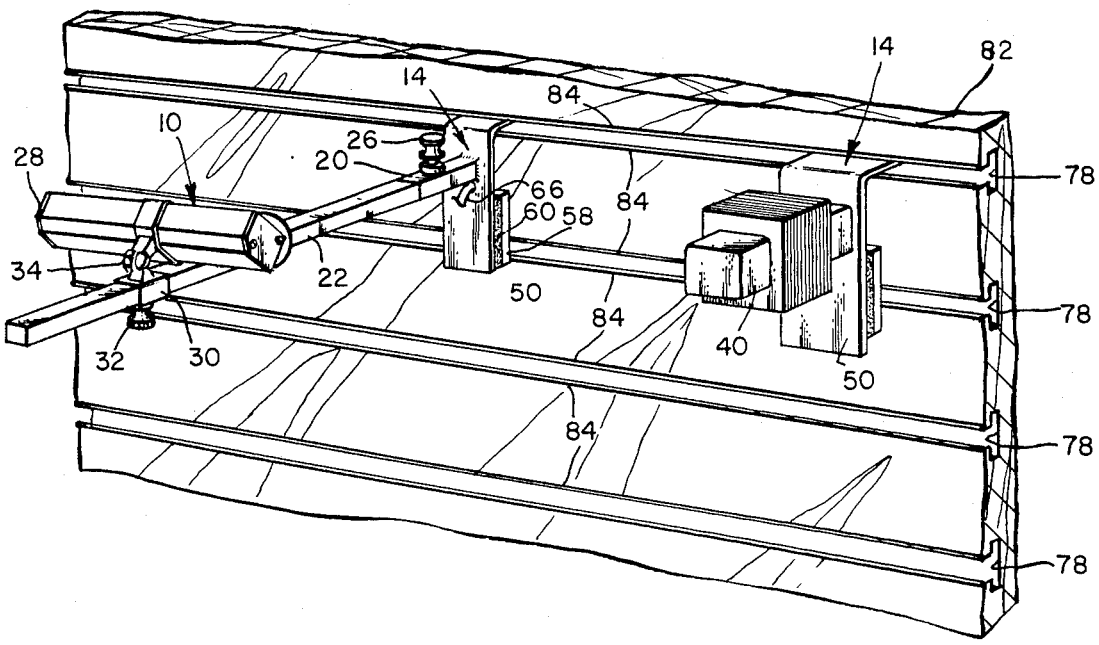
FIG. 10 is a perspective view of the present invention illustrating the lamp in an upward facing position, wherein the present invention is installed in reenforced slatwall.

The lamp is stationary in lamp housing 28, but through the arrangement of supports and adjustments provided in the present invention, the position of the lamp and the direction of the light cast from lamp housing 28 can be controlled with great precision and flexibility. Many adjustments of the light are found in the various features of lighting fixture 10 itself. First, lamp housing 28 can be slid back and forth along supporting arm 22 (that is, nearer to or farther from slatwall 12) when set screw 32 is loose, and held in the desired position by tightening set screw 32. Second, lamp housing can be rotated through 360 degrees of arc in either direction about the axis of rod 24 by rotating supporting arm 22 and rod 24, which are fixed together, when set screw 26 is loose, and can be held in the desired position by tightening set screw 26. Finally (FIGS. 2, 5), hinge member 34, held by bolt and nut 36, allows lamp housing 28 to pivot toward slatwall 16 or away from slatwall 16 until lamp housing 28 contacts supporting arm 22. These adjustments allow the lamp to be directed in virtually any direction. See, for example, the generally downward direction of the light beam illustrated in FIG. 5, and the inverted lamp housing position for directing the lighting upward illustrated in FIG. 10.

Additional lighting adjustment is provided by the nature of track electrodes 18 and the plurality of parallel slots in slatwall 12. First, mounting bracket 14 can be attached to any two adjacent slots 18 in slatwall 12, allowing lighting fixture 10 to be placed at any convenient height relative to the items being displayed. Naturally the lamp may be placed above or below the display items. Second, lighting fixture 10 may easily be slid along the entire length of any slot 18 in slatwall 12.

Mounting bracket 14, supporting arm 22, stub arm 20, and rod 24 may conveniently be made of the same material, which may be brass, steel, bronze, or other suitably attractive metal, and may be chrome plated. Stub arm 20 and supporting arm 22 may be conventional extrusions. It is desirable that these parts have matching exterior finishes since they will all be visible to people looking at the displays. Track electrodes 18 may be stainless steel, aluminium, copper, bronze, or other attractive metal that conducts electricity well.

Lighting fixture 10 is specially adapted for use with slatwall, or slatwall, display walls, which are very commonly used in retail point of sale displays and store windows. Slatwalls are customarily made of wood and have the general configuration shown by slatwall 12.

The slots in slatwalls are always parallel and separated by the same equal intervals in boards of the same style. Two styles of slatwall dominate the market. About eighty percent of slatwall has slots spaced apart by either two or three inches. Mounting bracket 14 according to the present invention is large enough to touch the next lower slot when the top of mounting bracket 14 is in its inserted position in a slot 18, whether the slots are two inches or three inches apart. Some twenty percent of the market for slatwall is filled by slatwall having parallel slots spaced six inches apart. Obviously, a bracket 14 can also be designed to accommodate a slatwall having these wider slats.

Figure 7:
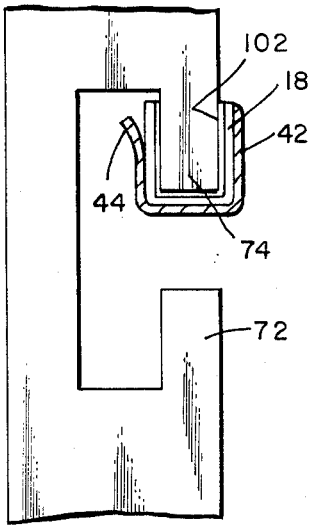
FIG. 7 is a sectional view taken along lines 6—6 of FIG. 6.

Slatwall is customarily available in either four foot or eight foot lengths. Often two or more slatwall sections are butted together to form a single display. The present invention includes clip 42, FIGS. 6, 7, consisting of a generally U-shaped channel of resilient metal that also conducts electricity well, for mechanically and electrically joining track electrodes 18 running through aligned slots of adjacent slatwall panels. Clip 42 overlaps each of track electrodes 18 about one inch, just long enough to insure good fastening. Clip 42 preferably has the same surface finish as track electrodes 18 of the same installation. Inner edge 44 of clip 42 is bent outward of the channel portion of clip 42 to insure that clip 42 is easy to install over track electrodes 18 even though the inner portion of the channel is designed for a resilient fit over track electrodes 18.

Electricity is conducted to the lamp by track electrodes 18 and contacts on mounting bracket 14 that contact the track electrodes by the force of gravity pulling on lighting fixture 10, and especially lamp housing 28. In the preferred embodiment described here, all lighting is with low voltage, preferably either 12 volts or 24 volts, but in any case less than 32 volts, the maximum level that is considered a low voltage. Low voltage systems do not need to be completely shielded from users with insulation, since exposure to the voltage will probably not even cause an electrical shock to a person who comes into contact with it. Using low voltage lamps enables the use of exposed track electrodes according to the present invention.

The low voltage power is supplied by conventional transformer 40, which reduces the conventional 120 volts to an alternating current output of 12 volts, or 24 volts, as desired. If desired, the output power can be rectified, although this is not necessary since the lamps used in the present invention do not flicker, even when operated with alternating current. Transformer 40 may be independently fused, although this is not usually necessary under local building codes since this is a low voltage and technically portable system.

In the preferred embodiment, lamps are low voltage, low wattage high output quartz-halogen incandescent lamps producing light having a color temperature of about 3,000 degrees K. This type of lamp produces about two and one-half times as much light per watt as ordinary incandescent lamps. For example, a fifty watt quartz-halogen bulb will produce as much light as an ordinary 120 watt bulb, but the light will be produced from a shorter filament, and so more tightly focused, and will have a higher color temperature. In addition, such quartz-halogen bulbs have life expectancy of about 3,000 hours. Such bulbs are available in a range of power consumptions, but in preferred embodiments according to the present invention the most useful ratings are 20 to 50 watts.

Any desired number of lighting fixtures 10 may be attached to a slatwall. The number of fixtures used is a manner of choice for the user, the constraint being that the power supply must be adequate. If, for example, a display will use 20 lamps and each lamp consumes 20 watts at 24 volts, a total of 400 watts will be consumed, which is about 17 amps. The power supply and transformer must be capable of handling these power requirements, plus the resistance of the track electrodes, which depends on the material they are made from and their length. The exact power supply requirements should be determined for each installation on a case by case basis.

Referring to FIG. 2, mounting bracket 14 includes a bracket plate 50 which has two spaced right angle bends 52, 54 near its top, forming flange 56 at the top of bracket plate 50 and in spaced parallel relationship to the larger, main portion of bracket plate 50. Any suitable shaped hook portion or flange that allows bracket 50 to hang from a slot in slatwall 12 is acceptable. The slot-catching portion of bracket 14, or flange 56 and the adjacent portion of bracket plate 50 serve as an electrical contact which touches track electrode **18*a* (FIG. 1) and conducts electricity between track electrode 18*a* and bracket plate 50, to which conducting wire 62** is soldered.

Lower contact plate 58 is separated from bracket plate 50 by one-quarter inch double-faced foam adhesive tape, which eliminates the need for any fasteners that penetrate either plate. Naturally, other insulators may be used. Lower contact plate 58 is held in place against track electrode **18*b* (FIG. 1) by the weight of lighting fixture 12. Wire 64 is soldered to lower contact plate 58 to provide a path for current to flow from track electrode 18*b* into lighting fixture 12**.

Wires 64, 66 come together to form an insulated electrical cord 66, as is well known in the art, which is connected from mounting bracket 14 to the lamp inside lamp housing 28. Cord 66 may conveniently be a naturally spiral wound black cord to minimize the visual distraction, and to allow adjustment of lamp housing 28 throughout the length of supporting arm 22, while maintaining a neat appearance.

It is also possible to do away with cord 66, if desired, in any of a number of manners. For example, a cord may be threaded through the center of a hollow supporting rod, much as conventional table and floor lamp cords are. This would reduce or elimenate the ajdustablity of the lamp housing along the supporting arm. In another alternative embodiment, the track electrode principle can be applied to the supporting arm and lamp housing itself, with the lamp housing bracket making contact with two separate eleotrical slide contacts along the supporting arm.

Referring to FIGS. 4, 5, transformer 40 may alsobe mounted conveniently on mounting bracket 14, which can then be hung directly on slatwall 12 in engagement with the two track electrodes 18 that lighting fixture 10 will be attached to. In this embodiment, the secondary output of transformer 40 is conducted into mounting bracket 14 by wires 64, 65 and then into track electrodes 18, from which the electricity is distributed to lighting fixtures 10. Naturally, the primary side of transformer 40 is connected to an ordinary 120 volt power source via cord 70, or other suitable means. Transformer 40 of FIGS. 4, 5 may be enclosed in an ornamental box to improve its appearance. This embodiment of the power supply and lighting fixture unit is especially useful when only one pair of slots in slatwall 12 will be used because it greatly simplifies installation and replacement, if necessary.

Referring to FIG. 3 there is shown an end view of track electrode 18, which is a generally U-shaped channel having right angle bents presenting a squared-off appearance, which fits firmly over square upward projecting lip 72, or downward projecting lip 74 of each slot of slatwall 12, throughout the four or eight foot length of slatwall 12. In practice, it is better to install all track electrodes 18 on downward projecting lip 72 because mounting bracket 14 must hang from the top of a slot, that is, must hang from a downward projecting lip and if all tracks are so installed, lighting fixture 10 may be installed on any two adjacent slots in slatwall 12.

The polarity of track electrodes 18, 18*a*, 18*b*, and so forth, alternates throughout the width of slatwall 12 on which track electrodes 18 have been installed. Lighting fixture 10, however, has no polarity, so it does not matter whether end flange 56 is electrically positive or negative, and it does not matter whether lower contact plate 58 is positive or negative. Flange 56 and lower contact plate 58 must naturally be different electrical potential.

Figure 11:
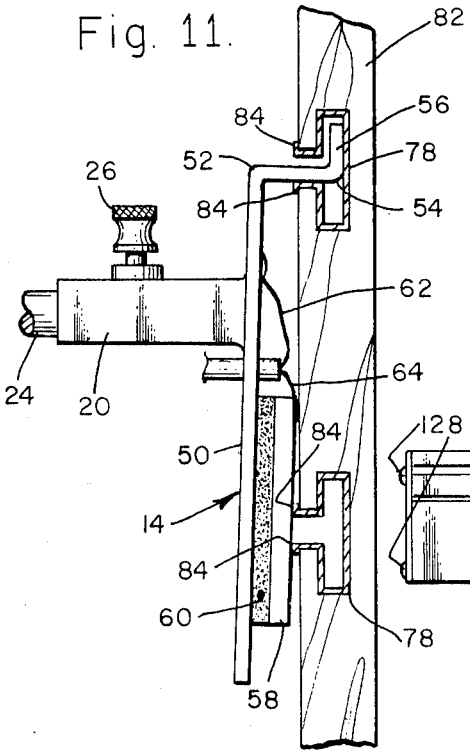
FIG. 11 is an end elevation of the edge of a showing the lamp bracket mounted in a reenforced slatwall.

Referring to FIG. 11, some slatwall 12 includes extruded aluminium reenforcement members 78 having a cross-section that matches the cross-section of slots 80, into which they fit firmly. Reenforcement member 78 permit more weight to be hung from slatwall 82. Reenforcement members 78 include lips 84 which extend outward of slots 80 and are bent at ninety degrees to become parallel to and in contact with the display surface of slatwall 82. Lips 84 may be utilized as track electrodes for application of the present invention, if desired. Alternatively, track electrodes 18 can also be easily used with the reenforced slatwall.

Figure 9:
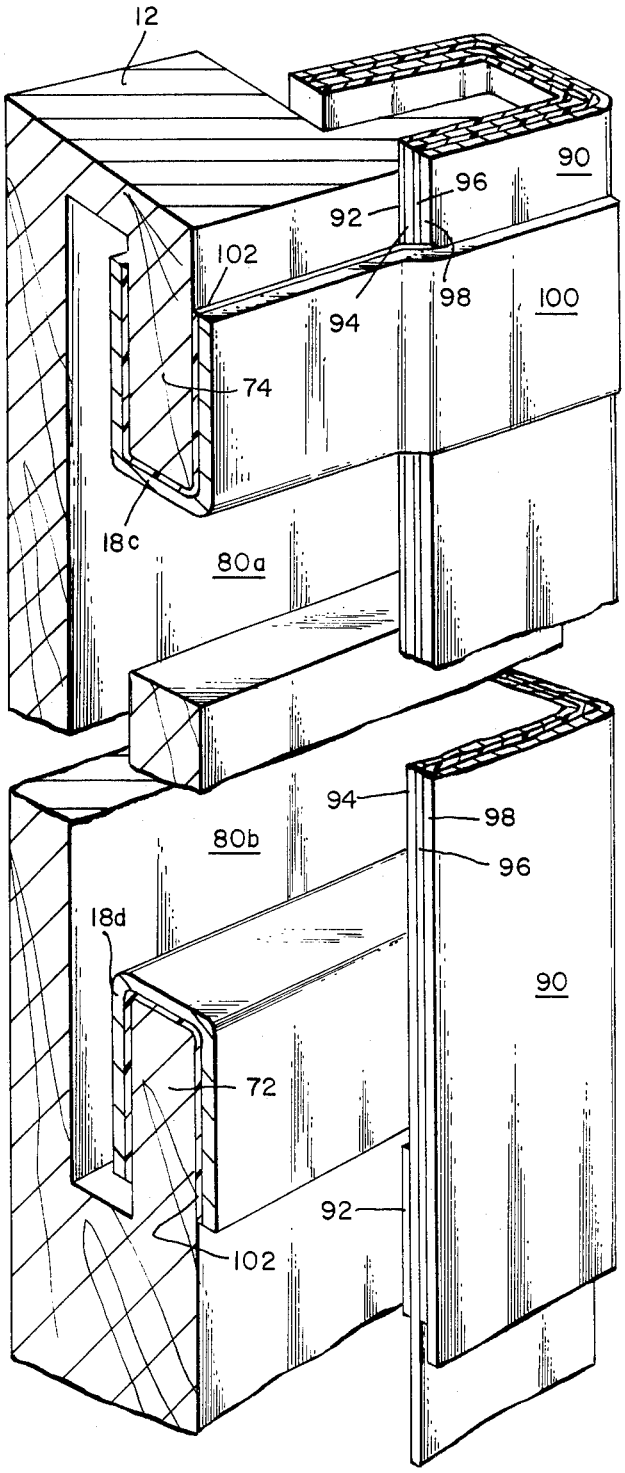
FIG. 9 is an enlarged perspective view partially cut away illustrating two slots of a typical slatwall section illustrating track electrodes connected by a bus bar according to the present invention.

Referring to FIGS. 2, 9, there is shown bus bar 90 along one vertical edge of slatwall 12 for conducting electricity to a plurality of track electrodes 18, which is a preferred alternative to electrically connecting a separate electrical lead from transformer 40 to each of track electrodes 18.

Referring to FIG. 9, track electrode 18*c* is seated on downward projecting lip 74 of slot 80*a* and track electrode 18*d* is seated on upward projecting lip 72 of slot 80*b*. Bus bar 90 consists of insulator 92, conductor 94, insulator 96, and conductor 98. Conductors 94, 96 may be of the same material as track electrodes 18. Insulators 92, 96 may be vinyl coating applied to the conductors, or may be double faced insulating adhesive tape. Bus bar 90 is formed into a U-shaped channel having squared off ends, and is designed to resiliently fit the edge of slatwall 12. Conductors 94, 96 naturally have different electrical potential during use so that a connection between any two adjacent track electrodes 18 will form a complete electrical circuit. One electrode from the secondary of transformer 40 is connected to conductor 94 and the other electrode is connected to conductor 98, thereby providing a different electrical polarity to each adjacent track electrode, which is always the case, regardless of the type of electrical transmission system used, and transformer 40 itself can be conveniently placed out of sight.

Track electrode 18*c* includes end 100 that is bent outwardly to resiliently engage conductor 98 of bus bar 90. Insulator 92 is removed from the portion of conductor 94 that contacts track electrode 18*d*. Corresponding track electrodes 18 are connected to bus bar 90 in a similar manner. Bus bar 90 further simplifies installation and maintenance of a lighting system according to the present invention.

Referring to FIG. 9, track electrodes 18*c*, 18*d* each include vinyl insulator 102 on the surface that contacts slatwall 12 to prevent electrical shorts if slatwall 12 becomes wet. Vinyl insulator 102 may be coated onto track electrodes by processes well known in the art. Alternatively, such insulator may be a spray or tape, such as vinyl spray or vinyl tape.

In a simpler, but not preferred, alternative embodiment, lamp housing 28, including a conventional 115 volt bulb and a cord for plugging into a conventional electrical wall socket, can be utilized with a bracket such as mounting bracket 14, without the necessity of using reduction transformers, low voltage systems, lower electrical contact plate 58 and the like. Such a use of mounting bracket 14, however, encounters the difficults of other permanent installations, produces more heat, and less vibrant light.

Referring to FIG. 8, lamp housing 28 includes glass lens 110 having the shape of a half cylinder, that is a cylinder cut lengthwise through a diameter of its circular cross-section, which includes frosted portions 112, 114, which reduce glare from bulb 29, and clear section 115, which allows light from bulb 29 to illuminate the display clearly and brightly. Glass lens 110 may be attached to lamp housing 28 by means of resilient metal clips. Valance panel 116, secured to support arm 22 by fastener 118 and set screw 119, may include printed messages, such as price or type of display items, or may merely hide lamp housing 28 from sight to prevent its distracting from the display.

Figure 12:
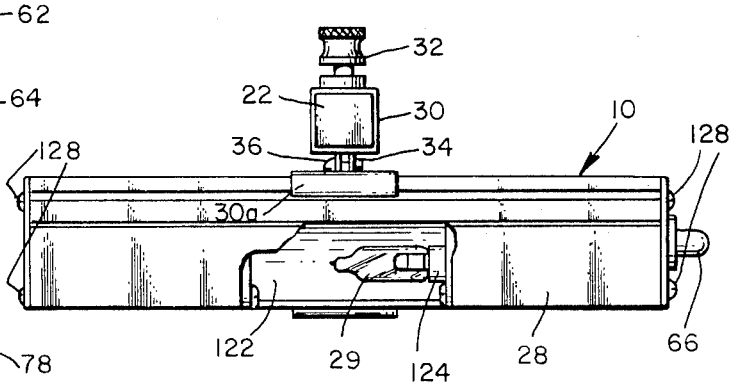
FIG. 12 is a front elevation of the lamp housing according to the present invention.

Referring to FIG. 12, there is shown lamp housing 28 including bulb 120 seated in socket 124 in front of reflector 122, these parts being fixed within lamp housing 28, which is a two piece snap-fit extrusion held firmly together by sheet metal screws 128. Bulb 120 is operatively connected to power cord 66.

The present invention is not intended to be restricted to any particular form or arrangement, or any specific embodiment disclosed herein, or any specific use, since the present invention may be modified in various particulars or relations without departing from the spirit or scope of the invention shown and described herein, of which the apparatus shown is intended only for disclosure of the best mode contemplated by the inventor for carrying out his invention, and not to show all of the various forms or modifications that might embody the invention.

Although the invention has been described in considerable detail, various modifications of the invention may occur to those skilled in the art. Accordingly, the scope of the patent property to be granted should be limited solely by the scope of the appended claims.

I claim:

1. An apparatus for lighting a slatwall, comprising:

a. At least two track electrodes, one said track electrode disposed in one slot of the slatwall and said second track electrode disposed in an ajacent slot in said slatwall;

b. at least one mounting bracket, said mounting bracket including a bracket body having an upper end and a lower end, said upper end terminating in a hook for retaining said bracket by gravity, a lower electrical contact plate fixed to said lower end of said bracket and electrically insulated therefrom, said hook inserted into the slot in the slatwall wherein the upper track electrode is disposed, retaining said mounting bracket therein and making electrical contact with said upper track electrode, and said lower electrical contact plate resting against and making electrical contact with said adjacent track electrode;

c. a supporting arm connected to said at least one bracket;

d. a lamp housing attached to said supporting arm;

e. means for conducting electricity from said bracket and from said lower contact plate to said lamp housing; and f. means for conducting electricity to said at least two track electrodes.

2. An apparatus in accordance with claim 1 wherein said means for conducting electricity to the electrodes comprises a bus bar having two conducting members separated from one another by electrical insulation, one said conducting member contacting alternating track electrodes and the other said conducting member contacting the remaining set to alternating electrodes.

3. A lighting fixture for use on a slatwall, comprising:

a. a mounting bracket having an upper end and a lower end, said upper end terminating in a hook for inserting said mounting bracket into a slot in the slatwall and retaining said mounting bracket by gravity;

b. a supporting arm having two ends, said supporting arm fastened at one end to said bracket;

c. a lamp housing attached proximate to said other end of said supporting arm by a slidably adjustable lamp bracket fitted about said supporting arm and said lamp housing;

d. a lower electrical contact plate fixed to the lower portion of said mounting bracket and electrically insulated e. at least two track electrodes, one said track electrode disposed in one slot of the slatwall and said second track electrode disposed in an adjacent slot in said slatwall, with said mounting bracket being mounted on said two adjacent track electrode, with said upper end of said mounting bracket making mechanical and electrical contact with said upper track electrode, and said lower electrical contact plate making mechanical and electrical contact with said lower track electrode; and f. means for conducting electricity from said bracket and from said lower contact plate to said lamp housing.

4. A method for lighting a slatwall, comprising the steps of:

a. inserting at least two track electrodes in adjacent slots of a slatwall;

b. electrically connecting one said track electrode to a one output lead of a source of low voltage electricity having two output leads;

c. electrically connecting the other said track electrode to the other said low voltage output lead;

d. hanging a mounting bracket and attached lamp assembly between said two track electrodes, said mounting bracket having an upper end comprising a hook and a lower end including an electrical contact plate fixed to said lower end of said bracket and electrically insulated therefrom, said upper end electrically contacting one of said track electrodes, and said lower end electrically contacting another of said track electrodes;

e. electrically connecting at least one lamp between said upper end of said mounting bracket and said electrical contact plate.

* * * * *